US008047627B2

(12) United States Patent
Ye

(10) Patent No.: US 8,047,627 B2
(45) Date of Patent: Nov. 1, 2011

(54) INKJET PRINTING CORRECTION METHOD AND INKJET PRINTING APPARATUS

(75) Inventor: Xiang-Qing Ye, Guangzhou (CN)

(73) Assignee: Primax Electronics Ltd., Taipei (TW)

( * ) Notice: Subject to any disclaimer, the term of this patent is extended or adjusted under 35 U.S.C. 154(b) by 114 days.

(21) Appl. No.: 12/436,532

(22) Filed: May 6, 2009

(65) Prior Publication Data

US 2010/0225692 A1 Sep. 9, 2010

(30) Foreign Application Priority Data

Mar. 6, 2009 (TW) ..... 98107287 A

(51) Int. Cl.
*B41J 29/393* (2006.01)
*B41J 29/38* (2006.01)

(52) U.S. Cl. ..... 347/19; 347/14

(58) Field of Classification Search ..... 347/14, 347/19

See application file for complete search history.

(56) References Cited

U.S. PATENT DOCUMENTS

| | | | | |
|---|---|---|---|---|
| 6,076,915 | A * | 6/2000 | Gast et al. | 347/19 |
| 7,456,983 | B2 * | 11/2008 | Meador et al. | 358/1.14 |
| 2005/0116983 | A1 * | 6/2005 | Wada et al. | 347/19 |
| 2008/0063341 | A1 * | 3/2008 | Kim et al. | 385/39 |

* cited by examiner

*Primary Examiner* — Matthew Luu
*Assistant Examiner* — Jannelle M Lebron
(74) *Attorney, Agent, or Firm* — Kirton & McConkie; Evan R. Witt

(57) ABSTRACT

An inkjet printing correction method is used with an inkjet printing apparatus. The inkjet printing correction method includes the following steps. Firstly, a first test image file is printed out as a print test pattern by the inkjet printing apparatus. Then, the print test pattern is scanned to obtain a second test image file. Then, all second block intervals are compared with respective first block intervals, thereby obtaining correction interval difference data. According to the comparing results, a procedure of ejecting ink droplets from the ink nozzles is determined to be advanced or delayed.

18 Claims, 5 Drawing Sheets

INKJET PRINTING CORRECTION METHOD AND INKJET PRINTING APPARATUS

FIELD OF THE INVENTION

The present invention relates to an inkjet printing apparatus, and more particularly to an inkjet printing apparatus for performing an inkjet printing correction method.

BACKGROUND OF THE INVENTION

With increasing development of personal computers, inkjet printing apparatuses are widely used as peripheral devices of personal computers. By means of the inkjet printing apparatus, the document file of a computer could be printed on many kinds of media (e.g. papers). FIG. 1 is a schematic perspective view illustrating an inkjet printing apparatus according to the prior art. As shown in FIG. 1, the inkjet printing apparatus 1 comprises an ink cartridge 10, multiple ink nozzles (not shown), a transmission mechanism 11, a paper input tray 12 and a paper output tray 13. The ink cartridge 10 is used for storing ink. The ink nozzles are disposed at the bottom of the transmission mechanism 11. The ink nozzles are moved by the transmission mechanism 11 such that ink could be ejected through the ink nozzles to be printed on any position of a blank paper P. The blank paper P is placed on the paper input tray 12. After an inkjet printing operation is performed, the paper P is exited to the paper output tray 13.

During the printing process of the inkjet printing apparatus 1, the blank paper P on the paper input tray 12 is fed into the inkjet printing apparatus 1 in a feeding direction Y and the transmission mechanism 11 is moved in a printing direction X. The printing direction X is perpendicular to the feeding direction Y. After the inkjet printing operation is completed, the paper P is exited to the paper output tray 13.

Generally, after the inkjet printing apparatus 1 is communicated with the computer and a print driver is installed, the inkjet printing apparatus 1 will perform a print testing operation. For performing the print testing operation, a first test image file stored in the computer is printed on a paper as a print test pattern. By visually examining the colors or image positions of the print test pattern, the user could discriminate whether the printing capability of the inkjet printing apparatus 1 is still satisfactory.

FIG. 2 is a schematic view illustrating a first test image file for performing the print testing operation by the inkjet printing apparatus according to the prior art. The first test image file T comprises multiple first blocks $b_{11}$~$b_{nn}$. The interval between every two adjacent first blocks is equal. For example, the first block $b_{11}$ and the first block $b_{12}$ are distant from each other by a first block interval $D_1$. The first block $b_{12}$ and the first block $b_{13}$ are distant from each other by another first block interval $D_2$. The first block $b_{11}$ and the first block $b_{21}$ are distant from each other by another first block interval $D_3$. The first block interval $D_1$, the first block interval $D_2$ and the first block interval $D_3$ are equal. Due to many factors adversely affecting to the inkjet printing apparatus 1, the intervals between adjacent physical blocks of the print test pattern are possibly unequal. For example, if the surface of the moving shaft of the transmission mechanism 11, which is disposed along the printing direction X, is not flat, the transmission mechanism 11 will be moved at inconsistent speeds during the printing operation of the inkjet printing apparatus 1. Under this circumstance, the print test pattern is erroneous.

For correcting the inkjet printing apparatus 1 and increasing the inkjet accuracy, the print test pattern is then scanned by an image scanner in order to obtain a second test image file. Similarly, the second test image file includes multiple second blocks. Every two adjacent first blocks are distant from each other by a second block interval. The positions and the intervals of the second blocks included in the second test image file are identical to those of the physical blocks included in the print test pattern. Next, the second block intervals of the second test image file are accumulated and an average value of the accumulated second block intervals is calculated. The average value is compared with the first block interval (e.g. $D_1$) of the first test image file T. According to the comparing result, the timing of ejecting the ink of the inkjet printing apparatus 1 is adjusted. After adjustment, the intervals between adjacent physical blocks of the print test pattern are equal to the average value.

Although the conventional printing correction method is effective to adjust the equal intervals of the physical blocks, there are still some drawbacks. For example, in comparison with the first test image file T, all blocks included in the adjusted print test pattern are slightly shifted. In other words, the images printed by the corrected inkjet printing apparatus 1 are somewhat distorted.

Therefore, there is a need of providing an inkjet printing correction method for obtaining a non-distorted image so as to obviate the drawbacks encountered from the prior art.

SUMMARY OF THE INVENTION

It is an object of the present invention to provide an inkjet printing correction method for obtaining a non-distorted image.

Another object of the present invention provides an inkjet printing apparatus with good printing performance.

In accordance with an aspect of the present invention, there is provided an inkjet printing correction method for use with an inkjet printing apparatus. The inkjet printing apparatus includes multiple ink cartridges for storing ink and multiple ink nozzles for ejecting ink. The inkjet printing correction method includes the following steps. Firstly, a first test image file is printed out as a print test pattern by the inkjet printing apparatus. The first test image file includes multiple first blocks. Every two adjacent first blocks are distant from each other by a first block interval. The print test pattern includes multiple physical blocks. Every two adjacent physical blocks are distant from each other by a physical block interval. Then, the print test pattern is scanned to obtain a second test image file. The second test image file includes multiple second blocks. Every two adjacent second blocks are distant from each other by a second block interval. Then, all second block intervals are compared with respective first block intervals, thereby obtaining corresponding comparing results. According to the comparing results, a procedure of ejecting ink droplets from the ink nozzles is determined to be advanced or delayed. If any first block interval is smaller than a corresponding second block interval, the procedure of ejecting ink droplets from the ink nozzles is advanced. Whereas, if any first block interval is larger than a corresponding second block interval, the procedure of ejecting ink droplets from the ink nozzles is delayed.

In an embodiment, the resulting results obtained by comparing all second block intervals with respective first block intervals are recorded as correction interval difference data, and the procedure of ejecting ink droplets from the ink nozzles is advanced or delayed according to the correction interval difference data.

In an embodiment, the inkjet printing apparatus further includes a memory for storing the correction interval difference data.

In an embodiment, the memory is a flash read-only memory or a non-volatile random access memory.

In an embodiment, the inkjet printing apparatus further includes a scanning module for scanning the print test pattern to the second test image file.

In an embodiment, the second block intervals of the second blocks and the physical block intervals of corresponding physical blocks are identical.

In an embodiment, the inkjet printing apparatus is an inkjet printer or a multifunction peripheral.

In accordance with another aspect of the present invention, there is provided an inkjet printing apparatus. The inkjet printing apparatus includes multiple ink cartridges for storing ink, multiple ink nozzles for ejecting ink, a transmission mechanism, a scanning module and a control unit. The transmission mechanism is connected with the ink cartridges and the ink nozzles for driving the ink cartridges and the ink nozzles to move in a first direction. The scanning module is used for performing a scanning operation. The control unit controls the ink nozzles and the transmission mechanism to perform an inkjet printing correction method. The inkjet printing correction method includes the following steps. Firstly, a first test image file is printed out as a print test pattern by the inkjet printing apparatus. The first test image file comprises multiple first blocks. Every two adjacent first blocks are distant from each other by a first block interval. The print test pattern includes multiple physical blocks. Every two adjacent physical blocks are distant from each other by a physical block interval. Then, the print test pattern is scanned to obtain a second test image file. The second test image file includes multiple second blocks. Every two adjacent second blocks are distant from each other by a second block interval. Then, all second block intervals are compared with respective first block intervals, thereby obtaining corresponding comparing results. According to the comparing results, a procedure of ejecting ink droplets from the ink nozzles is controlled to be advanced or delayed. If any first block interval is smaller than a corresponding second block interval, the procedure of ejecting ink droplets from the ink nozzles is advanced. Whereas, if any first block interval is larger than a corresponding second block interval, the procedure of ejecting ink droplets from the ink nozzles is delayed.

In an embodiment, the resulting results obtained by comparing all second block intervals with respective first block intervals are recorded as corresponding correction interval difference data by the control unit. The procedure of ejecting ink droplets from the ink nozzles is advanced or delayed according to the correction interval difference data under control of the control unit.

In an embodiment, the inkjet printing apparatus further includes a memory for storing the correction interval difference data.

In an embodiment, the memory is a flash read-only memory or a non-volatile random access memory.

In an embodiment, the second block intervals of the second blocks and the physical block intervals of corresponding physical blocks are identical.

In an embodiment, the first direction is perpendicular to a feeding direction of the print test pattern.

In an embodiment, the inkjet printing apparatus is an inkjet printer or a multifunction peripheral.

In accordance with a further aspect of the present invention, there is provided a multifunction peripheral. The multifunction peripheral includes multiple ink cartridges for storing ink, multiple ink nozzles for ejecting ink, a transmission mechanism, a scanning module and a control unit. The transmission mechanism is connected with the ink cartridges and the ink nozzles for driving the ink cartridges and the ink nozzles to move in a first direction. The scanning module is used for performing a scanning operation. The control unit controls the ink nozzles, the transmission mechanism and the scanning module to perform an inkjet printing correction method. The inkjet printing correction method includes the following steps. Firstly, a first test image file is printed out as a print test pattern by the inkjet printing apparatus. The first test image file includes multiple first blocks. Every two adjacent first blocks are distant from each other by a first block interval. The print test pattern includes multiple physical blocks. Every two adjacent physical blocks are distant from each other by a physical block interval. Then, the print test pattern is scanned to output a second test image file. The second test image file includes multiple second blocks. Every two adjacent second blocks are distant from each other by a second block interval. Then, all second block intervals are compared with respective first block intervals, thereby obtaining corresponding correction interval difference data. According to the correction interval difference data, a procedure of ejecting ink droplets from the ink nozzles is controlled to be advanced or delayed. If any first block interval is smaller than a corresponding second block interval, the procedure of ejecting ink droplets from the ink nozzles is advanced. Whereas, if any first block interval is larger than a corresponding second block interval, the procedure of ejecting ink droplets from the ink nozzles is delayed.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 3:
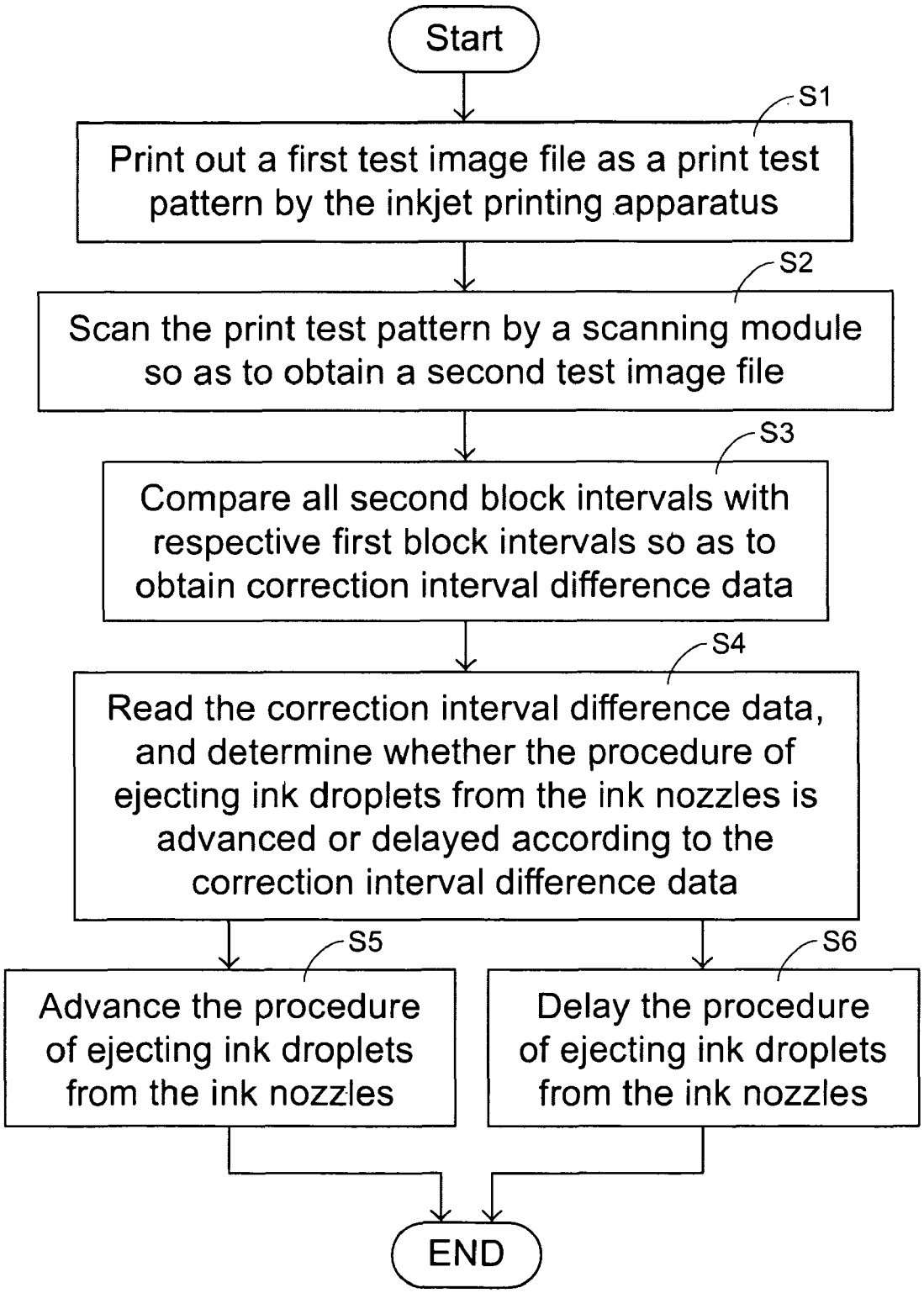
FIG. 3 schematically illustrates a flowchart of an inkjet printing correction method according to an embodiment of the present invention.

For obviating the drawbacks encountered from the prior art, the present invention provides an inkjet printing correction method. FIG. 3 schematically illustrates a flowchart of an inkjet printing correction method according to an embodiment of the present invention. After the inkjet printing correction method is started, a first test image file is printed on a paper as a print test pattern by the inkjet printing apparatus (Step S1). Next, the print test pattern is scanned by a scanning module of the inkjet printing apparatus so as to obtain a second test image file (Step S2). Next, all second block intervals of the second test image file are compared with respective first block intervals of the first test image file, thereby obtaining correction interval difference data (Step S3). Next, the correction interval difference data are read. According to the correction interval difference data, the inkjet printing apparatus determines whether the procedure of ejecting ink droplets from the ink nozzles is advanced or delayed (Step S4). If the correction interval difference data indicates that any first block interval is smaller than a corresponding second block interval, the procedure of ejecting ink droplets from the ink nozzles is controlled to be advanced (Step S5). Whereas, if the correction interval difference data indicates that any first block interval is larger than a corresponding second block interval, the procedure of ejecting ink droplets from the ink nozzles is controlled to be delayed (Step S6).

Figure 4:
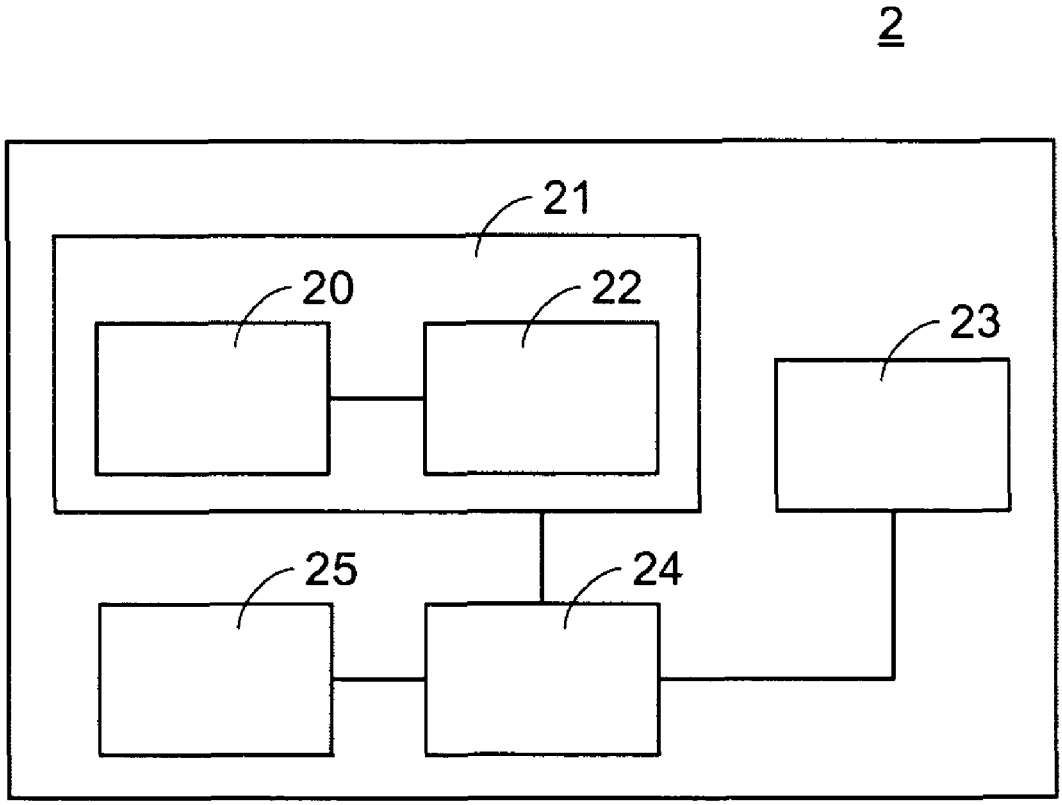
FIG. 4 is a schematic block diagram illustrating an inkjet printing apparatus according to an embodiment of the present invention.

For implementing the inkjet printing correction method, the present invention also provides an inkjet printing apparatus. FIG. 4 is a schematic block diagram illustrating an inkjet printing apparatus according to an embodiment of the present invention. As shown in FIG. 4, the inkjet printing apparatus 2 comprises multiple ink cartridges 20, a transmission mechanism 21, multiple ink nozzles 22, a scanning module 23, a control unit 24 and a memory 25. The ink cartridges 20 comprise four color ink cartridge, including a cyan ink cartridge, a magenta ink cartridge, a yellow ink cartridge and a black ink cartridge. The ink nozzles 22 are connected with the ink cartridges 20 for ejecting different colors of ink droplets. The transmission mechanism 21 is connected with the ink cartridges 20 and the ink nozzles 22 for driving the ink cartridges 20 and the ink nozzles 22 to move in a first direction. The first direction is perpendicular to the paper feeding direction. After the print test pattern is printed out by the inkjet printing apparatus 2, the print test pattern is scanned by the scanning module 23 into the second test image file. The correction interval difference data are stored in the memory 25. An example of the memory 25 includes but is not limited to a flash read-only memory (flash ROM) or a non-volatile random access memory (NVRAM). The control unit 24 is used for implementing the calculating and comparing tasks and assigning tasks to associated components.

Figure 1:
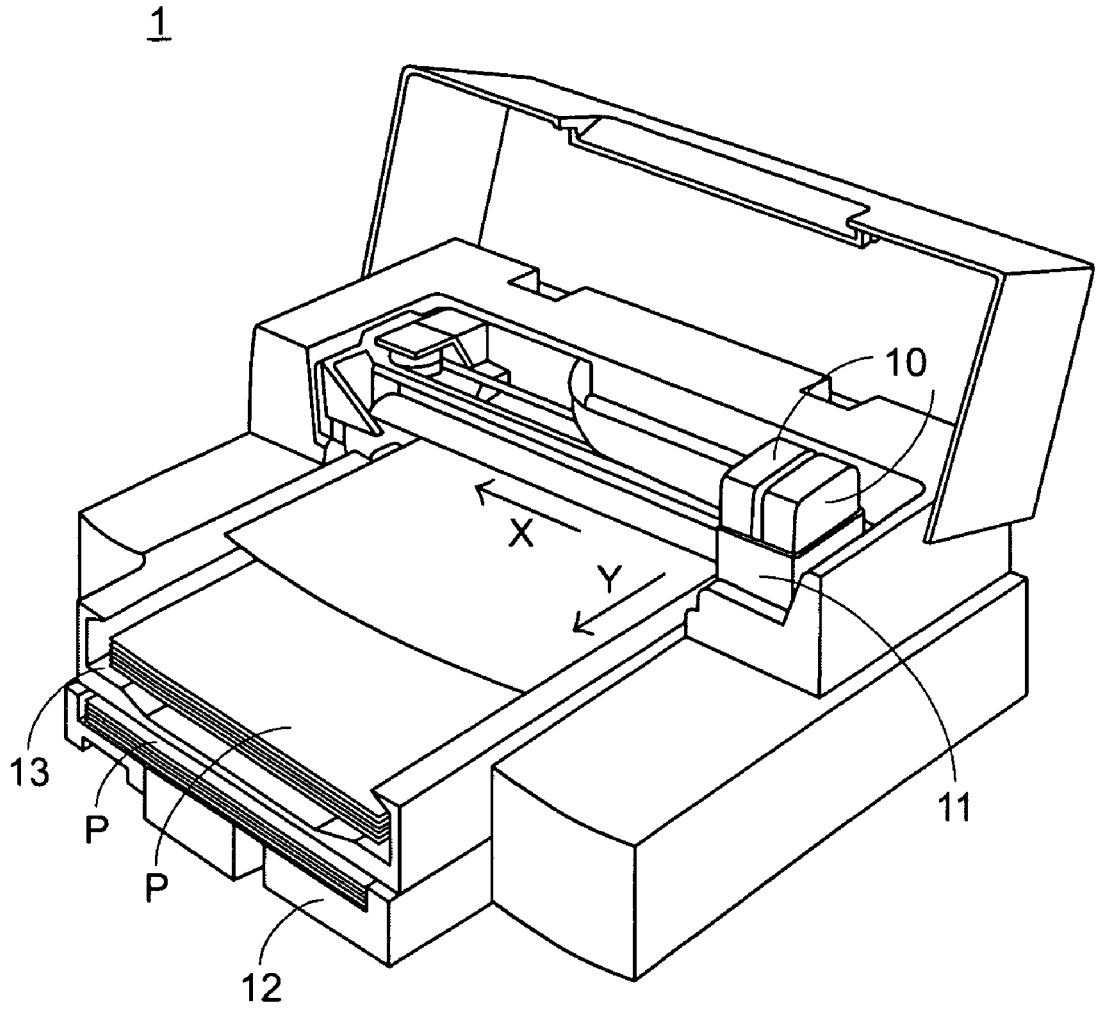
FIG.1 PRIOR ART
FIG. 1 is a schematic perspective view illustrating a inkjet printing apparatus according to the prior art.
Figure 2:
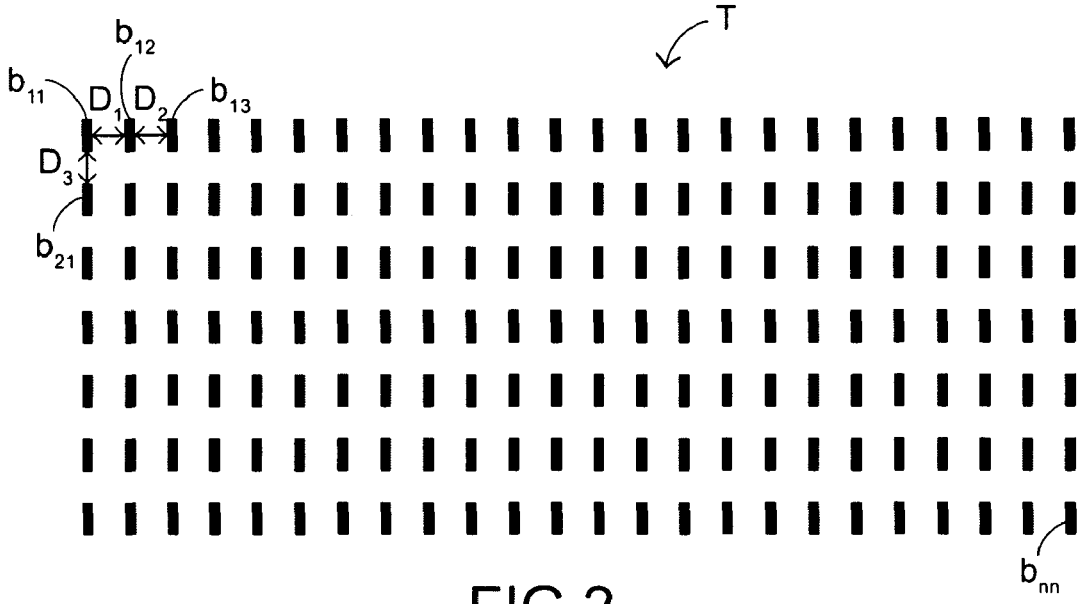
FIG.2 PRIOR ART
FIG. 2 is a schematic view illustrating a first test image file for performing the print testing operation by the conventional inkjet printing apparatus according to the prior art.
Figure 5:
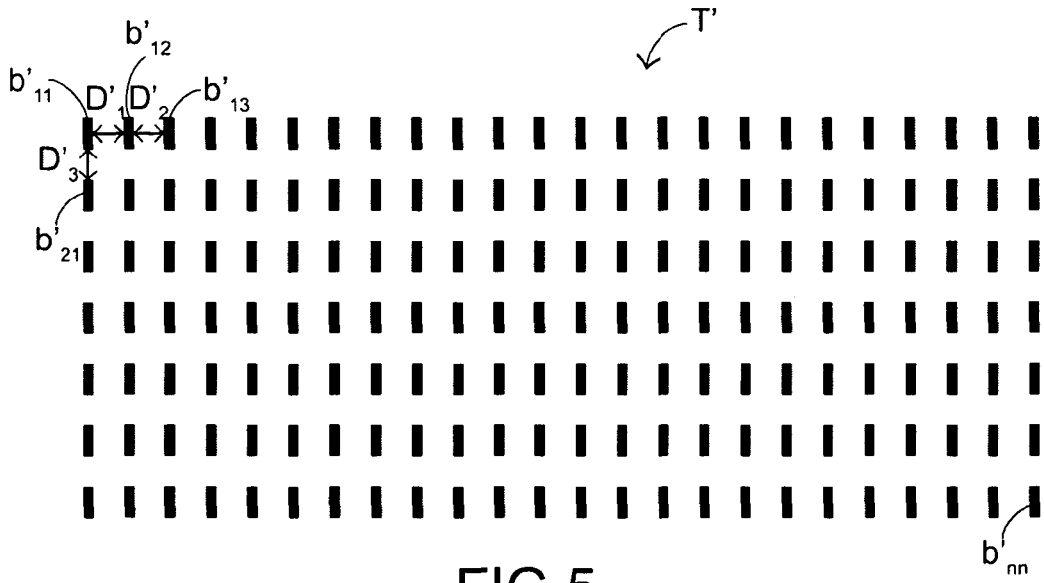
FIG. 5 is a schematic view illustrating a second test image file obtained by the scanning module of the inkjet printing apparatus of the present invention.

Hereinafter, the inkjet printing correction method of the present invention will be illustrated in more details with reference to FIGS. 3, 4 and 5. When the ink cartridges 20, the ink nozzles 22 and the transmission mechanism 21 of the inkjet printing apparatus 2 cooperate with each other to perform a print testing operation, a first test image file stored in the computer is printed on a paper as a print test pattern (see Step S1 of FIG. 3). The first test image file comprises multiple first blocks. Every two adjacent first blocks are distant from each other by a first block interval. The print test pattern comprises multiple physical blocks. Every two physical blocks are distant from each other by a physical block interval. The contents of the first test image file are similar to those shown in FIG. 2, and are not redundantly described herein. The first test image file T comprises multiple first blocks $b_{11}$~$b_{mn}$. Likewise, the first block interval $D_1$, the first block interval $D_2$ and the first block interval $D_3$ are equal, i.e. D1=D2=D3.

For comparing the first test image file with the print test pattern, the print test pattern is scanned by the scanning module 23 of the inkjet printing apparatus 2 so as to obtain a second test image file (see Step S2 of FIG. 3). FIG. 5 is a schematic view illustrating a second test image file obtained by the scanning module of the inkjet printing apparatus of the present invention. The second test image file T' comprises multiple second blocks $b'_{11}$~$b'_{mn}$. Every two adjacent second blocks are distant from each other by a second block interval. As shown in FIG. 5, the second block $b'_{11}$ and the second block $b'_{12}$ are distant from each other by a second block interval $D'_1$. The second block $b'_{12}$ and the second block $b'_{13}$ are distant from each other by another second block interval $D'_2$. The second block $b'_{11}$ and the second block $b'_{21}$ are distant from each other by another second block interval $D'_3$. It is of course that the contents of the second test image file T' are substantially identical to those of the physical print test pattern.

After the scanning operation is completed, the control unit 24 of the inkjet printing apparatus 2 will compare all second block intervals of the second test image file with respective first block intervals of the first test image file, thereby obtaining correction interval difference data (see Step S3 of FIG. 3). For example, after the second block interval $D'_1$ of the second test image file T' is compared with first block interval $D_1$ of the first test image file T, the control unit 24 discriminates that the second block interval $D'_1$ is smaller than the first block interval $D_1$ and calculates a difference between the second block interval $D'_1$ and the first block interval $D_1$ as a correction interval difference data. Similarly, the control unit 24 discriminates that the second block interval $D'_2$ is larger than the first block interval $D_2$ and calculates a difference between the second block interval $D'_2$ and the first block interval $D_2$ as another correction interval difference data. Similarly, the control unit 24 discriminates that the second block interval $D'_3$ is smaller than the first block interval $D_3$ and calculates a difference between the second block interval $D'_3$ and the first block interval $D_3$ as another correction interval difference data. These correction interval difference data are stored in the memory 25. The rest may be deduced by analogy.

Next, the correction interval difference data are read. According to the correction interval difference data, the inkjet printing apparatus determines whether the procedure of ejecting ink droplets from the ink nozzles is advanced or delayed (see Step S4 of FIG. 3). When the comparing result obtained by comparing the first block interval $D'_1$ and the second block interval $D_1$ is realized according to the correction interval difference data (i.e. the second block interval $D'_1$ is smaller than the first block interval $D_1$), the control unit 24 computes a first delaying time according to the difference between the second block interval $D'_1$ and the first block interval $D_1$ and the moving speed of the transmission mechanism 21. At this moment, the procedure of ejecting ink droplets is controlled to be delayed (see Step S1 of FIG. 6). When the comparing result obtained by comparing the first block interval $D'_2$ and the second block interval $D_2$ is realized according to the correction interval difference data (i.e. the second block interval $D'_2$ is larger than the first block interval $D_2$), the control unit 24 computes a second advancing time according to the difference between the second block interval $D'_2$ and the first block interval $D_2$ and the moving speed of the transmission mechanism 21. At this moment, the procedure of ejecting ink droplets from the ink nozzles is controlled to be advanced (see Step S1 of FIG. 5). When the comparing result obtained by comparing the first block interval $D'_3$ and the second block interval $D_3$ is realized according to the correction interval difference data (i.e. the second block interval $D'_3$ is smaller than the first block interval $D_3$), the control unit 24 computes a third delaying time according to the difference between the second block interval $D'_3$ and the first block interval $D_3$ and the moving speed of the transmission mechanism 21. At this moment, the procedure of ejecting ink droplets is controlled to be delayed (see Step S1 of FIG. 6). The rest may be deduced by analogy.

From the above description, the inkjet printing correction method of the present invention is capable of correcting the ink shift on the basis of the difference between the first test image file and the print test pattern. All first blocks of the first test image file and all physical blocks of the print test pattern are successively compared. The difference between all first blocks and respective physical blocks are calculated in order to make fine-tuning adjustment of the ink shift. As a consequence, the ink droplets ejected from the ink nozzles could be printed on desired positions. For comparing the first test image file (electronic file) and the print test pattern (physical paper), the print test pattern is scanned by the scanning module into a second test image file (electronic file). The contents of the second test image file are substantially identical to those of the print test pattern.

As previously described in the prior art, all blocks included in the adjusted print test pattern are slightly shifted and the images printed by the corrected inkjet printing apparatus are somewhat distorted. In the inkjet printing correction method of the present invention, the ink shift of every block is corrected according to the difference between every block and the corresponding physical block. That is, all physical blocks included in the print test pattern are corrected to be consistent with the respective first blocks of the first test image file in order to obtain a non-distorted image. Since the inkjet printing correction method of the present invention corrects the physical print test pattern that is directly printed out by the inkjet printing apparatus, the mechanical errors are simultaneously corrected.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An inkjet printing correction method for use with an inkjet printing apparatus, said an inkjet printing apparatus comprising multiple ink cartridges for storing ink and multiple ink nozzles for ejecting ink, said inkjet printing correction method comprising steps of:

printing out a first test image file as a print test pattern by said inkjet printing apparatus, wherein said first test image file comprises multiple first blocks, every two adjacent first blocks are distant from each other by a first block interval, said print test pattern comprises multiple physical blocks, and every two adjacent physical blocks are distant from each other by a physical block interval;

scanning said print test pattern with a scanning module of said inkjet printing apparatus to obtain a second test image file, wherein said second test image file comprises multiple second blocks, every two adjacent second blocks are distant from each other by a second block interval;

comparing all second block intervals with respective first block intervals, thereby obtaining corresponding comparing results; and determining whether a procedure of ejecting ink droplets from said ink nozzles is advanced or delayed according to said comparing results, wherein if any first block interval is smaller than a corresponding second block interval, said procedure of ejecting ink droplets from the ink nozzles is advanced, or if any first block interval is larger than a corresponding second block interval, said procedure of ejecting ink droplets from the ink nozzles is delayed.

2. The inkjet printing correction method according to claim 1 wherein said second block intervals of said second blocks and said physical block intervals of corresponding physical blocks are identical.

3. The inkjet printing correction method according to claim 1 wherein said inkjet printing apparatus is an inkjet printer or a multifunction peripheral.

4. The inkjet printing correction method according to claim 1 wherein said resulting results obtained by comparing all second block intervals with respective first block intervals is recorded as corresponding correction interval difference data, and said procedure of ejecting ink droplets from the ink nozzles is advanced or delayed according to said correction interval difference data.

5. The inkjet printing correction method according to claim 4 wherein said inkjet printing apparatus further comprises a memory for storing said correction interval difference data.

6. The inkjet printing correction method according to claim 5 wherein said memory is a flash read-only memory or a non-volatile random access memory.

7. An inkjet printing apparatus comprising:

multiple ink cartridges for storing ink;

multiple ink nozzles for ejecting ink;

a transmission mechanism connected with said ink cartridges and said ink nozzles for driving said ink cartridges and said ink nozzles to move in a first direction;

a scanning module for performing a scanning operation; and a control unit for controlling said ink nozzles and said transmission mechanism to perform an inkjet printing correction method, said inkjet printing correction method comprising steps of:

printing out a first test image file as a print test pattern by said inkjet printing apparatus, wherein said first test image file comprises multiple first blocks, every two adjacent first blocks are distant from each other by a first block interval, said print test pattern comprises multiple physical blocks, and every two adjacent physical blocks are distant from each other by a physical block interval;

scanning said print test pattern to obtain a second test image file, wherein said second test image file comprises multiple second blocks, every two adjacent second blocks are distant from each other by a second block interval;

comparing all second block intervals with respective first block intervals, thereby obtaining corresponding comparing results; and controlling a procedure of ejecting ink droplets from said ink nozzles to be advanced or delayed according to said comparing results, wherein if any first block interval is smaller than a corresponding second block interval, said procedure of ejecting ink droplets from the ink nozzles is advanced, or if any first block interval is larger than a corresponding second block interval, said procedure of ejecting ink droplets from the ink nozzles is delayed.

8. The inkjet printing apparatus according to claim 7 wherein said second block intervals of said second blocks and said physical block intervals of corresponding physical blocks are identical.

9. The inkjet printing apparatus according to claim 7 wherein said first direction is perpendicular to a feeding direction of said print test pattern.

10. The inkjet printing apparatus according to claim 7 wherein said inkjet printing apparatus is an inkjet printer or a multifunction peripheral.

11. The inkjet printing apparatus according to claim 7 wherein said resulting results obtained by comparing all second block intervals with respective first block intervals are recorded as corresponding correction interval difference data by said control unit, and said procedure of ejecting ink droplets from the ink nozzles is advanced or delayed according to said correction interval difference data under control of said control unit.

12. The inkjet printing apparatus according to claim 11 further comprising a memory for storing said correction interval difference data.

13. The inkjet printing apparatus according to claim 12 wherein said memory is a flash read-only memory or a non-volatile random access memory.

14. A multifunction peripheral comprising:

multiple ink cartridges for storing ink;

multiple ink nozzles for ejecting ink;

a transmission mechanism connected with said ink cartridges and said ink nozzles for driving said ink cartridges and said ink nozzles to move in a first direction;

a scanning module for performing a scanning operation; and a control unit for controlling said ink nozzles, said transmission mechanism and said scanning module to perform an inkjet printing correction method, said inkjet printing correction method comprising steps of:

printing out a first test image file as a print test pattern by said inkjet printing apparatus, wherein said first test image file comprises multiple first blocks, every two adjacent first blocks are distant from each other by a first block interval, said print test pattern comprises multiple physical blocks, and every two adjacent physical blocks are distant from each other by a physical block interval;

scanning said print test pattern to output a second test image file, wherein said second test image file comprises multiple second blocks, every two adjacent second blocks are distant from each other by a second block interval;

comparing all second block intervals with respective first block intervals, thereby obtaining corresponding correction interval difference data; and controlling a procedure of ejecting ink droplets from said ink nozzles to be advanced or delayed according to said correction interval difference data, wherein if any first block interval is smaller than a corresponding second block interval, said procedure of ejecting ink droplets from the ink nozzles is advanced, or if any first block interval is larger than a corresponding second block interval, said procedure of ejecting ink droplets from the ink nozzles is delayed.

15. The multifunction peripheral according to claim 14 further comprising a memory for storing said correction interval difference data.

16. The multifunction peripheral according to claim 14 wherein said memory is a flash read-only memory or a non-volatile random access memory.

17. The multifunction peripheral according to claim 14 wherein said second block intervals of said second blocks and said physical block intervals of corresponding physical blocks are identical.

18. The multifunction peripheral according to claim 14 wherein said first direction is perpendicular to a feeding direction of said print test pattern.

* * * * *